US009890028B2

(12) United States Patent
Chase

(10) Patent No.: US 9,890,028 B2
(45) **Date of Patent: *Feb. 13, 2018**

(54) MULTIPLE INLET DISPENSING APPARATUS AND SYSTEM FOR PREPARING BEVERAGES

(71) Applicant: WHIRLPOOL CORPORATION, Benton Harbor, MI (US)

(72) Inventor: Kevin M. Chase, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 229 days.

This patent is subject to a terminal disclaimer.

(21) Appl. No.: 14/677,126

(22) Filed: Apr. 2, 2015

(65) Prior Publication Data

US 2015/0210525 A1 Jul. 30, 2015

Related U.S. Application Data

(63) Continuation of application No. 12/915,130, filed on Oct. 29, 2010, now Pat. No. 9,046,300.

(51) Int. Cl.

| | |
|---|---|
| ***B67D 7/78*** | (2010.01) |
| ***B67D 7/84*** | (2010.01) |
| ***B67D 7/76*** | (2010.01) |
| ***B67D 7/80*** | (2010.01) |
| ***B65D 35/56*** | (2006.01) |
| ***B67D 1/10*** | (2006.01) |
| ***F25D 23/12*** | (2006.01) |
| ***B67D 1/08*** | (2006.01) |

(52) U.S. Cl.

CPC ..... *B67D 1/10* (2013.01); *B67D 1/0889* (2013.01); *B67D 1/0894* (2013.01); *F25D 23/12* (2013.01); *F25D 23/126* (2013.01); *F25C 2400/12* (2013.01)

(58) Field of Classification Search

CPC ..... B67D 1/0889; B67D 1/0894

See application file for complete search history.

(56) References Cited

U.S. PATENT DOCUMENTS

| | | | | | |
|---|---|---|---|---|---|
| 2,842,290 | A * | 7/1958 | Dodge | H01J 9/395 | 222/167 |
| 3,882,828 | A * | 5/1975 | Honiden | F02B 53/00 | 123/208 |
| 4,708,266 | A * | 11/1987 | Rudick | B67D 1/0036 | 222/105 |
| 4,753,370 | A | 6/1988 | Rudick | | |
| 5,058,768 | A * | 10/1991 | Lichfield | B01F 15/047 | 222/1 |

(Continued)

*Primary Examiner* — Frantz Jules
*Assistant Examiner* — Filip Zec
(74) *Attorney, Agent, or Firm* — Nyemaster Goode, P.C.

(57) ABSTRACT

A liquid dispensing apparatus and system for controlling the delivery of liquid additives is disclosed. In one aspect, liquid additives are delivered to a beverage preparation system through a multiple inlet pump for preparing a finished beverage. In another aspect, additives from liquid additive containers are delivered to a beverage preparation system through a multiple inlet and pumping section pump for preparing a finished beverage. Other additives are communicated through the beverage dispensing system for maintaining and cleaning the system and the multiple inlet pump for ensuring the hygienical integrity of the system throughout its use.

20 Claims, 9 Drawing Sheets

(56) References Cited

U.S. PATENT DOCUMENTS

| | | | | |
|---|---|---|---|---|
| 6,095,783 | A * | 8/2000 | Hansen | F01C 21/0827 418/245 |
| 6,137,978 | A * | 10/2000 | Tsuchiya | G03G 15/0868 222/167 |
| 6,145,705 | A * | 11/2000 | Wallace | A47G 19/34 222/160 |
| 6,625,993 | B2 | 9/2003 | Frank et al. | |
| 6,756,069 | B2 | 6/2004 | Scoville et al. | |
| 6,889,603 | B2 | 5/2005 | Carhuff et al. | |
| 6,905,314 | B2 | 6/2005 | Danby | |
| 7,044,335 | B2 | 5/2006 | Aguirre et al. | |
| 7,614,524 | B2 | 11/2009 | Girard et al. | |
| 7,651,015 | B2 | 1/2010 | Girard et al. | |
| 7,674,100 | B2 * | 3/2010 | Hayes-Pankhurst | A61M 5/14232 418/125 |
| 2006/0051228 | A1 * | 3/2006 | Hayes-Pankhurst | A61M 5/14232 418/61.2 |
| 2008/0173705 | A1 | 7/2008 | Girard et al. | |
| 2010/0219205 | A1 * | 9/2010 | Jennison | F25C 5/002 222/167 |

* cited by examiner

MULTIPLE INLET DISPENSING APPARATUS AND SYSTEM FOR PREPARING BEVERAGES

CROSS-REFERENCE TO RELATED APPLICATION

The present application is a continuation of U.S. patent application Ser. No. 12/915,130 filed 29 Oct. 2010, entitled MULTIPLE INLET DISPENSING APPARATUS AND SYSTEM FOR PREPARING BEVERAGES, which is incorporated herein by reference in its entirety.

FIELD OF THE INVENTION

The present invention relates to a multiple inlet dispensing apparatus and system for preparing beverages, and more particularly, to an apparatus and system for preparing beverages by use of a pump having multiple inlets and pumping sections thereby delivering separate or multiple additives or ingredients to a beverage preparation system for dispensing or preparing beverages.

BACKGROUND OF THE INVENTION

Dispensing liquid from an indoor dispenser, a refrigerator or other liquid dispensing platform is well known. In fact, many new and existing liquid dispensing platforms, such as a refrigerator have an indoor or other dispenser having a liquid outlet to dispense liquid. Although these existing refrigerators can dispense liquid from a dispenser, including ice from an ice dispenser, no concept or platform exists where the refrigerator, or other liquid dispensing appliance, is configured with a multiple inlet dispensing apparatus and system for dispensing separate or multiple additives or ingredients for preparing beverages. Therefore, a need has been identified in the art to provide a multiple inlet dispensing apparatus and system for use in a liquid dispensing appliance, such as a refrigerated appliance for dispensing separate or multiple additives or ingredients for preparing beverages.

Dispensing multiple additives or ingredients for preparing a beverage is known. The existing platforms use a separate pump associated with each additive or ingredient for dispensing the same for preparing a beverage. The use of multiple pumps for dispensing multiple additives or ingredients is an unnecessary business expense. Therefore, a need has been identified in the art to provide a multiple inlet pump dispensing apparatus and system having multiple pump sections in fluid communication with multiple inlets for delivering separate or multiple additives or ingredients to a beverage preparation system for dispensing or preparing beverages.

BRIEF SUMMARY OF THE INVENTION

According to one aspect of the present invention, a dispensing apparatus is disclosed. The dispensing apparatus includes a pump housing having a primary inlet, a secondary inlet offset from the primary inlet, and an outlet. The dispensing apparatus also includes a first container having a first additive and connected in fluid communication to the primary inlet, a second container having a second additive and connected in fluid communication to the secondary inlet, and a pumping system configured for pumping fluid through the primary inlet and the secondary inlet and out through the outlet. The pump housing includes a first pumping section for pumping fluid through the primary inlet and a second pumping section for pumping fluid through the secondary inlet.

According to another aspect of the present invention, a fluid dispensing system for preparing beverages is disclosed. This system includes a disposable housing, a pump having a primary inlet, a secondary inlet, and an outlet. The outlet passes through a wall of the disposable housing. A first and second container is included within the disposable housing, wherein the first and second containers hold a first additive and a second additive respectively. A pump housing is configured for pumping the first additive through the primary inlet and the second additive through the secondary inlet and out the outlet. In a further aspect of the system, a first valve is connected in fluid communication to the primary inlet and a second valve connected in fluid communication to the secondary inlet for controlling flow of the first and second additives through the pump housing.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings, in which:

DETAILED DESCRIPTION OF THE PREFERRED EMBODIMENTS

The present invention is directed to a refrigerator and other additive dispensing devices and appliances such as a countertop/tabletop water dispenser, water dispensing cabinet, or beverage vending machine. In particular, the present invention provides for a refrigerated appliance or other liquid dispensing device, platform or appliance, having an interface for receiving a multiple inlet and single or multiple pump housing additive apparatus, or the same device, platform or appliance including an integrated additive dispensing system operating in combination with a beverage preparation system for preparing and dispensing a finished beverage.

Figure 1:
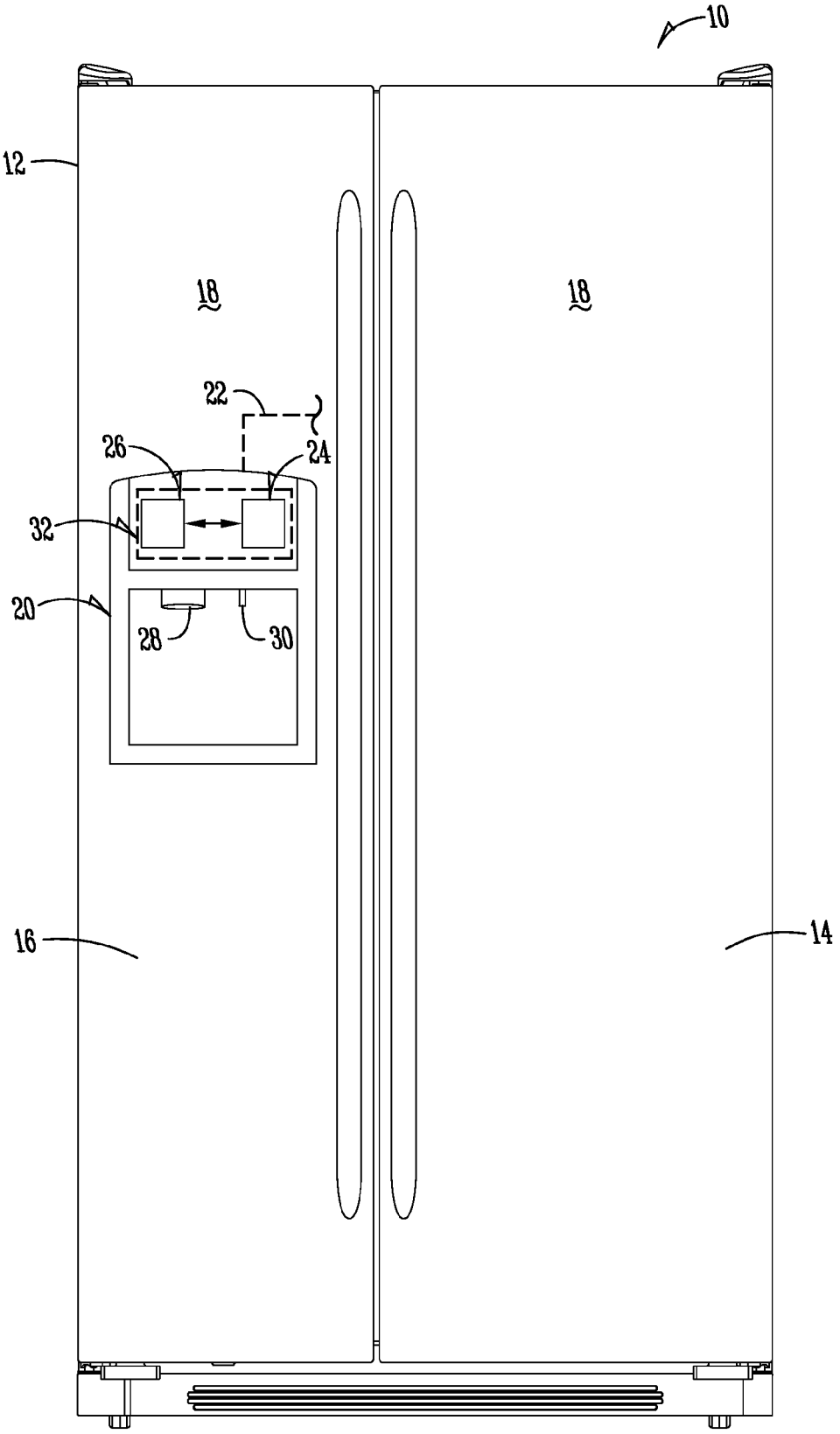
FIG. 1 is a front elevation view of a refrigerator illustrating a dispensing apparatus and system of the present invention.

FIG. 1 illustrates a refrigerator 10 having a cabinet body 12 including a refrigerated compartment 14 and a freezer compartment 16 associated with the cabinet body 12. The refrigerator 10 includes a dispenser, such as a liquid and/or ice/water dispenser 20 in one of the doors 18 of the refrigerator 10. As is customary, the dispenser 20 receives liquid from a liquid source 22 such as a plumbed waterline associated with a domestic, commercial or residential dwelling. The liquid source 22 could also be a bottled source such as where water is stored and dispensed from a bottle at or remote to the refrigerator. Liquid from liquid source 22 may be stored in a liquid holding reservoir (not shown), before or after being filtered through an inline filter, and communicated to the beverage dispensing system 32 at the dispenser 20. The dispenser 20 includes one or both of an ice dispenser 28 and a liquid dispenser 30 for dispensing ice and/or liquid from the dispenser 20. Dispenser 20 also includes a beverage preparation system 24 in operable communication with a liquid additive system 26. The beverage preparation system 24 and liquid additive system 26 operate together to provide a beverage dispensing system 32 at the dispenser 20.

Figure 2:
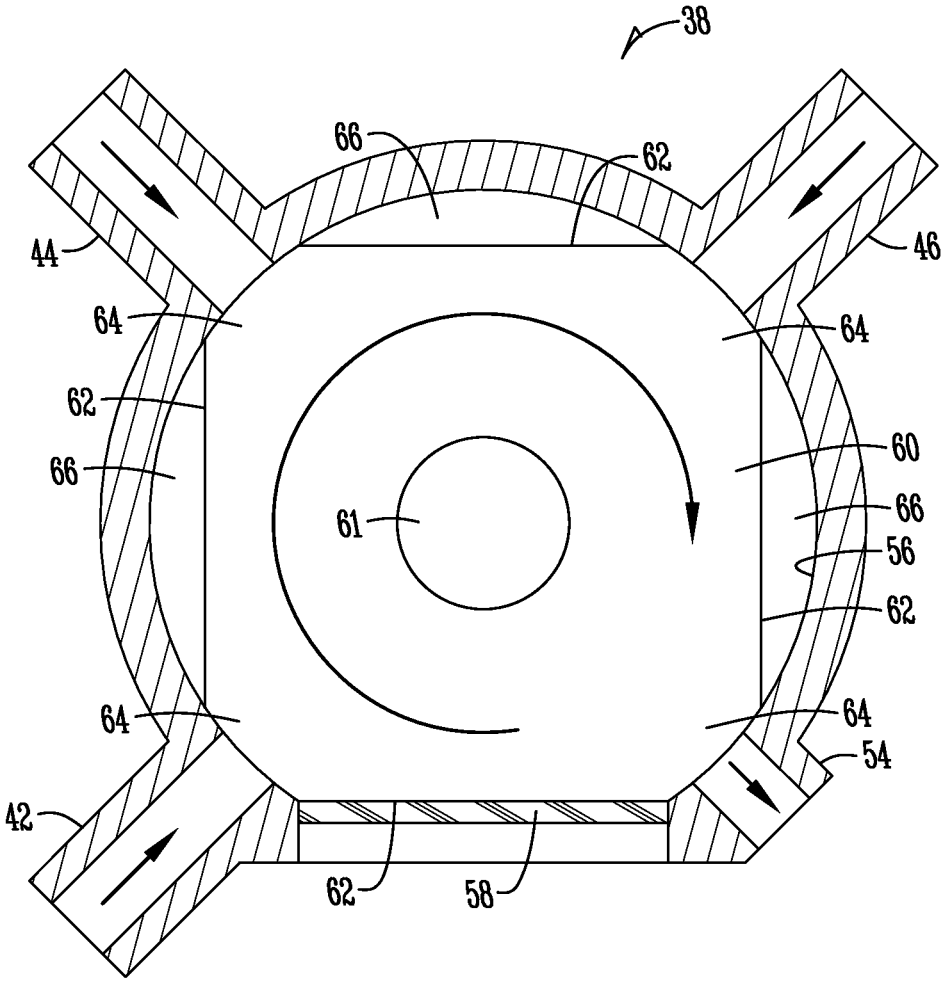
FIG. 2 is an illustration depicting a multiple inlet pump according to one aspect of the present invention.

FIG. 2 illustrates one embodiment of a Quantex pump suitable for use in advancing liquid additives or ingredients from a additive container to an outlet for combining with a liquid for dispensing and/or preparing a beverage. A similar pump is disclosed in U.S. application Ser. No. 11/069,043 entitled "PUMPS" filed on Mar. 2, 2005, and is hereby incorporated by reference. The pump 38 includes a pump housing 40 having two or more inlets and an outlet 54. In one aspect of the invention, pump 38 includes a primary inlet 42, a secondary inlet 44 and a tertiary inlet 46. Within the pump housing 38 is included a rotor 60 set upon and rotated by shaft 61. The pump housing 40 includes an inner wall 56 in which the apices 64 of rotor 60 are in contact with during rotation of rotor 60. The rotor 60 includes outer surfaces 62 spaced apart from inner wall 56 of pump housing 40 thereby creating a plurality of closed chambers 66. The geometry of the outer surface 62 may be altered to decrease or increase the volume of the closed chamber 66. A portion of the inner wall 56 comprises a seal 58. The seal 58 is preferably an elastomeric member that seats against the outer surface 62 of rotor 60 upon rotation of the outer surface 62 into contact with seal 58. Liquid from one or more sources is ducted/pumped into the closed chamber 66 through one of the inlets and subsequently forced out of the outlet 54 as a result of the sealing action provided by seal 58 against the outer surface 62 of rotor 60. The pump 38 illustrated in FIG. 2 comprises a single pumping section as opposed to the pump 38 illustrated in FIG. 5A which includes multiple pumping sections and will be discussed in greater detail infra.

Figure 3:
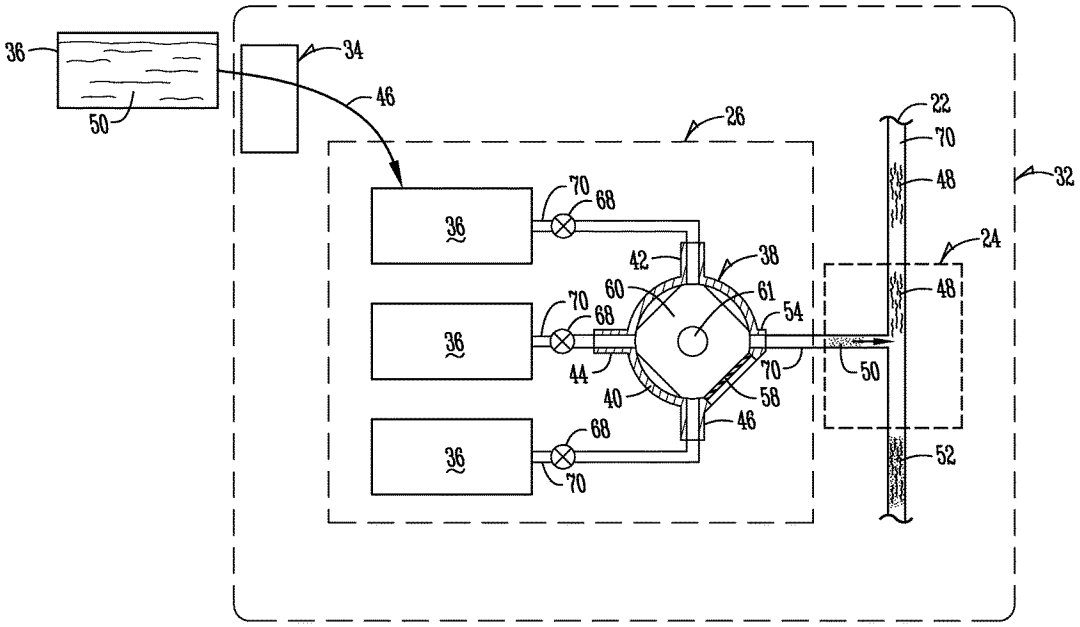
FIG. 3 is an illustration depicting a dispensing system and multiple inlet pump according to one aspect of the present invention.

FIG. 3 illustrates a liquid additive system 26 incorporated into a beverage dispensing system 32, such as a beverage preparation system in a liquid dispensing appliance. The present invention contemplates that the liquid additive system 26 may be used in combination with any type of system, platform, or appliance where additives or other ingredients are dispensed therefrom using a single, inexpensive pump, which in some aspects of the invention is disposable being part of a consumable. The liquid additive system 26 includes a pump 38, such as the one illustrated in FIG. 2 of the invention. Each inlet of the pump housing 40 is connected in liquid communication with a liquid additive container 36. In one aspect of the invention, a conduit 70 is connected to an inlet of pump 38 and liquid additive container 36. A micro actuated valve 68, such as an electrostatic microvalve, electromagnetic microvalve, piezoelectric microvalve, bimetallic microvalve, thermopneumatic microvalve, or a shape memory alloy actuation valve, may be included inline to conduit 70 and connected between liquid additive container 36 and an inlet of pump 38. The liquid additive system 26 includes a pump 38 having a primary inlet 42, a secondary inlet 44 and a tertiary inlet 46. The primary inlet 42 is connected to a liquid additive container 36 by conduit 70. Similarly, other liquid additive containers 36 are connected by a conduit 70 to the secondary inlet 44 and tertiary inlet 46 of the pump housing 40. The pump 38 includes a motor powered by a power source 82, such as an electrical chemical cell, for providing rotation to rotor 60. The outlet 54 of pump 38 is connected to the beverage preparation system 24. The beverage preparation system 24 may be the liquid dispensing system such as dispenser 20 associated with refrigerator 10 illustrated in FIG. 1. The beverage preparation system 24 includes a conduit 70 connected to a liquid source 22. The outlet 54 of pump 38 is connected in liquid communication with a conduit 70 connected to the liquid source 22. Liquid 48 is combined and/or mixed with additive 50 for preparing a beverage 52. In operation, a liquid additive container 36 contains a liquid additive 50. The liquid additive 50 may include any flavoring or concentrate component and may include such things as a brew, a nutraceutical, a medicine, a mineral, a vitamin, or an aroma in liquid form. The liquid additive 50 could be any combination of the aforementioned liquid additives. The liquid additive 50 could also be any combination of the aforementioned liquid additives where one additive interacts with another or with liquid 48 being dispensed from the liquid dispensing appliance to provide a finished or complete beverage 52. The liquid additive container 36 is a consumable component of the system. Containers 36 are inserted, the liquid additive 50 is spent, and the used containers removed and replaced with a new liquid additive container 36. For example, depending upon the desired beverage, the requisite liquid additive container 36 is selected and inserted into the liquid additive system 26 through an additive loading/unloading interface 34. The additive loading/unloading interface 34 provides a location for inserting and removing additives or ingredients from the beverage dispensing appliance. For example, the refrigerator 10 illustrated in FIG. 1 may include an additive loading and unloading interface on the cabinet body 12 such as one of the doors 18. The loading and unloading additive interface 34 may also be configured into the operator interface of dispenser 20. The loading and unloading interface is preferably at a location associated with the liquid dispensing appliance where a user or operator can conveniently load and unload a liquid additive container 36. The loading and unloading interface 34 may also be configured in an exterior portion, such as an exterior skin of the liquid dispensing appliance, or an interior portion such as a refrigerator or freezer compartment associated with the refrigerated appliance shown in FIG. 1. Through the interface, a user or operator may load a liquid additive container 36 into the liquid additive system 26 and remove a spent container.

The pump illustrated in FIG. 3 is configured with a primary inlet 42, secondary inlet 44, and a tertiary inlet 46. Each inlet is connected in liquid communication with a liquid additive container 36. The pump 38 could be configured to have two, three, or several inlets to accommodate connection to two, three, or several liquid additive containers 36.

The electronics associated with pump 38, such as its motor, are electrically connected to a control board, not shown, associated with operator controls of the liquid dispensing appliance. For example, the electronics for operating the pump 38 could be electronically connected to the operating system associated with the dispenser 20 of refrigerator 10 illustrated in FIG. 1. Similarly, the micro actuator valves 68 are electrically connected to a control board or controller whereby instructions from the operator or user, such as those input by a user or operator at an operating interface, are communicated from the controller or control board to the micro actuator valve 68 and pump 38 to control dispensing of liquid additives 50. A display associated with the liquid dispensing appliance, such as a display associated with dispenser 20 on refrigerator 10 shown in FIG. 1, may be configured to apprise the operator or user of the different types of liquid additives currently docked within the liquid additive system 26. Using the list of liquid additive containers 36, a user/operator is able to select the specific type of liquid additive 50 needed to prepare the desired beverage 52. Upon selection of the desired additive or ingredient, the liquid additive system 26 receives instruction from a controller or control board for operating pump 38 and one or more micro actuated valves 68. In the case where the liquid additive system 26 is dispensing from a single liquid additive container 36, one of the micro actuator valves 68 opens and the rotor 60 within pump housing 40 rotates to pump liquid additive 50 from the liquid additive containers 36 through the inlet and out the outlet 54 to combine the liquid additive 50 with the liquid 48 from source 22 to prepare a complete or finished beverage 52. In the case where multiple additives are needed to prepare the finished or complete beverage 52, two or more of the micro actuated valves 68 may open up simultaneously or sequentially to allow liquid additive components 50 within two or more of the liquid additive container 36 to be drawn into the pump 38 and dispensed through outlet 54 into the liquid stream to combine with liquid 48 to prepare a finished or complete beverage 52. When the beverage dispense cycle is complete, the controller or control board associated with the liquid dispensing appliance issues an instruction to end the pump cycle and close the micro actuator valve(s) 68. The present invention contemplates that other liquid components may be loaded into the liquid additive system 26 for maintaining the liquid additive system 26 and the beverage preparation system 24. For example, a liquid additive container 36 containing a de-scaling agent or component, or other anti-microbial agents suitable for use with food grade components may be inserted and the system cycled for cleaning conduit 70, pump 38, micro actuator valves 68 and other components of the system exposed to liquid additives or ingredients.

Figure 4A:
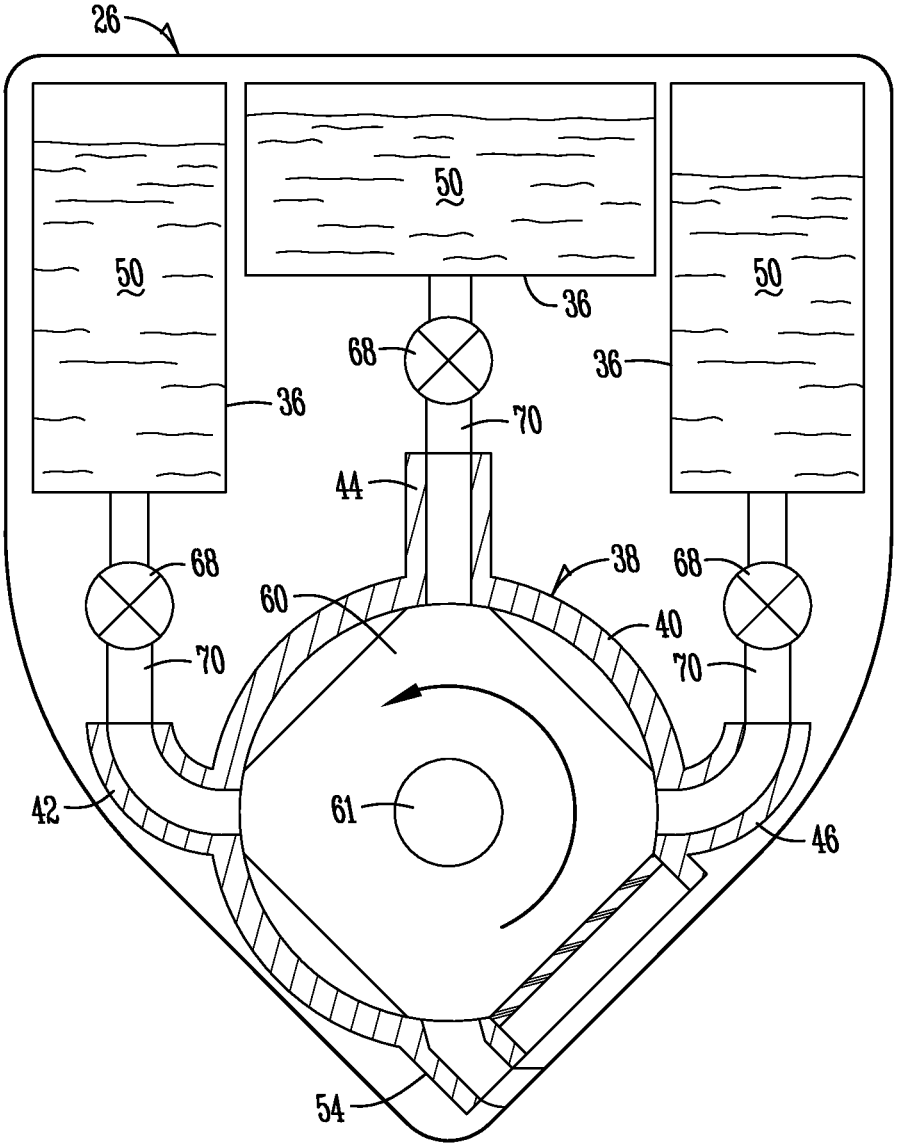
FIG. 4A is a diagram illustration of a multiple inlet, single pump housing and additive dispensing apparatus for use as a consumable in a beverage preparation system.
Figure 4B:
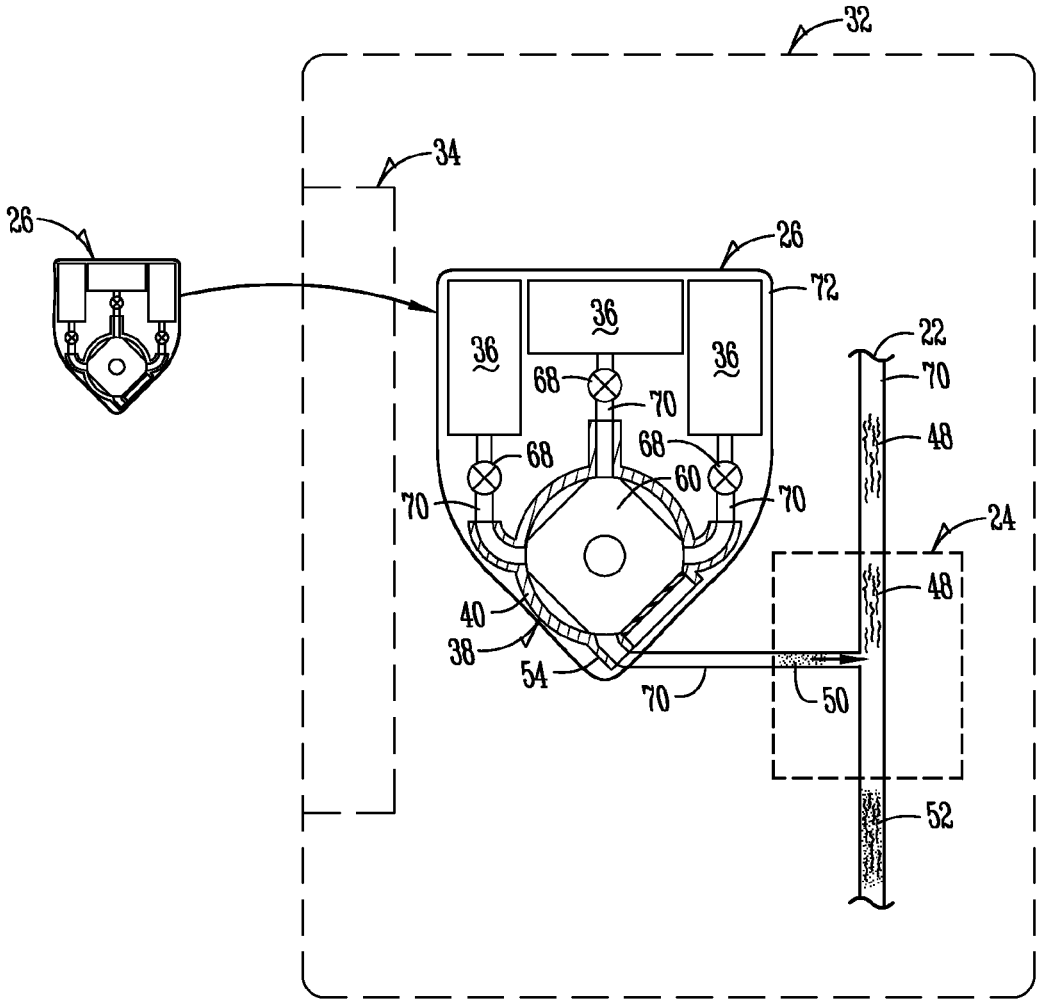
FIG. 4B is a diagram illustration of the apparatus shown in FIG. 4A being used in combination with a beverage preparation system.

FIGS. 4A-B illustrate another aspect of the invention. The liquid additive system 26 illustrated in FIG. 4A is configured as a disposable or consumable device. The liquid additive system 26 is also configured for use in combination with a beverage preparation system 24 as previously described. The liquid additive system 26 illustrated in FIG. 4A includes a housing 72. The housing 72 may be in the form of a capsule, pouch, pod, or other housing shape, material or design suitable for use as a consumable. Within the housing 72 is included a pump 38, such as the pump illustrated in FIG. 2. Also included within the housing 72 are multiple liquid additive containers 36. Each liquid additive container 36 is connected by a conduit 70 to an inlet associated with pump housing 40 of pump 38. As with previous aspects of the invention illustrated and discussed supra, a micro actuated valve 68 is connected between the liquid additive container 36 and the inlet of pump housing 40. The outlet 54 of pump 38 passes through housing 72 so that liquid additive 50 from a liquid additive container 36 may be dispensed from the housing 72. At a location on the housing 72 (not shown), an electronics interface is provided whereby instructions from a controller or control board associated with the liquid dispensing platform, such as the refrigerator dispenser in FIG. 1, are communicated to actuate the motor (not shown) associated with the pump 38 and the micro actuated valves 68 for operating the liquid additive system 26. The components associated with the liquid additive system 26 are preferably of minimal cost such that the liquid additive system 26 may be disposed of after a single use or multiples uses. The liquid additive system 26 shown in FIG. 4A is designed to be a consumable. The liquid additive system 26 may be configured with two, three or several liquid additive containers 36. Some of the containers may include a liquid additive such as a flavoring or concentrate for preparing a finished or complete beverage. In one aspect of the present invention, or the case of a multiple use liquid additive system 26, one of the liquid additive containers 36 may include an anti-microbial agent or an anti-scaling component suitable for use in food grade components to prevent scaling, deposits and other contamination resulting in any of the components associated with the liquid additive system 26 and/or the beverage preparation system 24 in which the liquid additive system 26 is used. A single use liquid additive system 26 could include also a de-scaling or anti-microbial liquid component for treating and cleaning elements and components associated with the beverage preparation system 24 at the end of the cycle of the liquid additive system 26.

FIG. 4B illustrates the liquid additive system 26 used in combination with a beverage preparation system 24 such as the beverage preparation system 24 associated with a dispenser 20 of a refrigerator 10 illustrated in FIG. 1. The present invention contemplates that the liquid additive system 26 may be used in combination with any liquid dispensing platform such as those listed supra. As shown in FIG. 4B, the liquid dispensing platform may include a beverage dispensing system 32. The beverage dispensing system 32 may include a additive loading and unloading interface 34. Liquid additive system 26 may be loaded and unloaded (inserted and retrieved) through the additive loading and unloading interface 34. The beverage dispensing system 32 also includes a beverage preparation system 24 having a liquid source 22 in fluid communication with a conduit 70 for providing a liquid for preparing a beverage. Liquid 48 from source 22 travels through conduit 70 connected to another conduit 70 attached in liquid communication with the outlet 54 of pump 38. The beverage dispensing system 32 is configured whereby the liquid additive system 26 is docked so that the outlet 54, when the liquid additive system 26 is in the docking position, is connected in liquid communication with conduit 70 associated with the beverage preparation system 24. When the liquid additive system 26 is docked within the beverage dispensing system 32 the electronic controls associated with the liquid additive system 26 are brought into electronic communication with the controls, controller or control board associated with the liquid platform in which the liquid additive system 26 is used. For example, when the liquid additive system 26 is docked in the beverage dispensing system 32, electronic controls of liquid additive system are brought into communication with the controller or control board associated with the liquid dispensing platform such as a refrigerator dispenser whereby instructions from a user or operator provided at the interface of the dispenser are communicated to the liquid additive system 26 for controlling pump 38 and micro actuated valve(s) 68.

In operation, as illustrated in FIG. 4B, the liquid additive system 26 is loaded into the beverage dispensing system 32. The particular liquid additive system 26 may be selected depending upon the type of liquid additive component in each of the liquid additive containers 36. In the case where a certain type of beverage is desired, a certain type of liquid additive system 26 may be selected having liquid additive containers 36 containing the desired liquid additive components. Alternatively, depending on the desired finished beverage 52, a user/operator may select the appropriate liquid additive in liquid additive container 36. The liquid additive container then may be inserted into the housing 72 so that the liquid additive system 26 includes all of the desired liquid additive components in their respective liquid additive containers contained within the housing 72. For example, the user/operator could acquire the requisite liquid additive containers containing the necessary flavor or concentrate for preparing the desired finished beverage 52 and insert these containers into the housing 72, and in turn insert the housing 72 into the beverage dispensing system 32. When the liquid additive system 26 is docked within the beverage dispensing system 32, the outlet 54 of the pump 38 is connected in liquid communication with conduit 70 and an electronics interface (not shown) associated with the housing 72 is brought into electrical communication with the opposing electronics interface associated with the liquid dispensing platform. Instructions received from a user/operator are communicated from a control or control board to the liquid additive system 26 for operating the motor (not shown) associated with pump 38 and the micro actuated valve(s) 68 within housing 72. For example, in the instance where a multi-flavored beverage is desired, two or more of the micro actuated valves 68 may be instructed to open when or during operation of pump 38 whereby liquid additive components 50 may be communicated through the pump housing 40 and outlet 54 into the beverage preparation system 24 for combining with liquid 48 from liquid source 22 for preparing a complete or finished beverage 52. When the beverage is complete and the liquid additive system 26 has completed its dispensing cycle, and assuming the liquid additive system is a single use system, the user/operator is instructed to remove the liquid additive system and dispose of it. A new liquid additive system 26 replaces the old one. The present invention contemplates that the liquid additive system may include a de-scaling or anti-microbial component contained within a liquid additive container 36; this component, after the beverage has been prepared, is dispensed through the pump housing 40 and beverage preparation system 24 for preventing contamination of the beverage preparation system and/or the beverage dispensing system 32. In addition to a liquid additive system 26 containing multiple and/or various flavor-type concentrates or other liquid components for preparing a complete beverage, a liquid additive system 26 may be configured with a treatment system for removing contaminants, treating and preserving components associated with the beverage dispensing system 32. For example, one liquid component could be a de-scaling agent, another liquid component could be an anti-microbial agent and another a conditioning component. Another liquid component could be a conduit treating agent to preserve the life of the conduit and/or care for the components associated with pump 38. In either case, the liquid additive system 26, whether dispensing liquids for maintaining the beverage dispensing system 32 or for preparing a finished or complete beverage, may be configured as a consumable part of the beverage dispensing system 32.

Figure 5A:
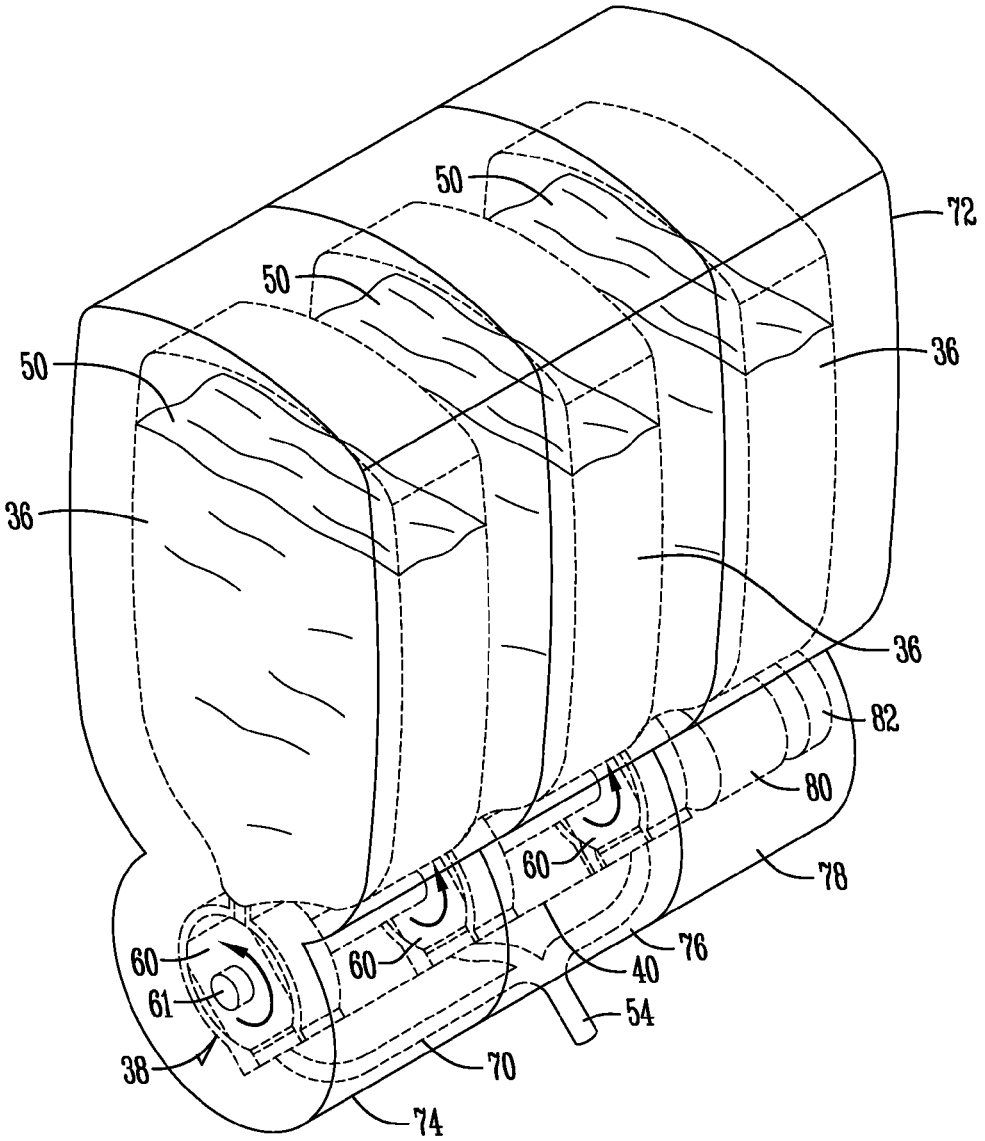
FIG. 5A is a illustration depicting a multiple inlet and pump housing additive dispensing apparatus for use as a consumable in a beverage preparation system.
Figure 5B:
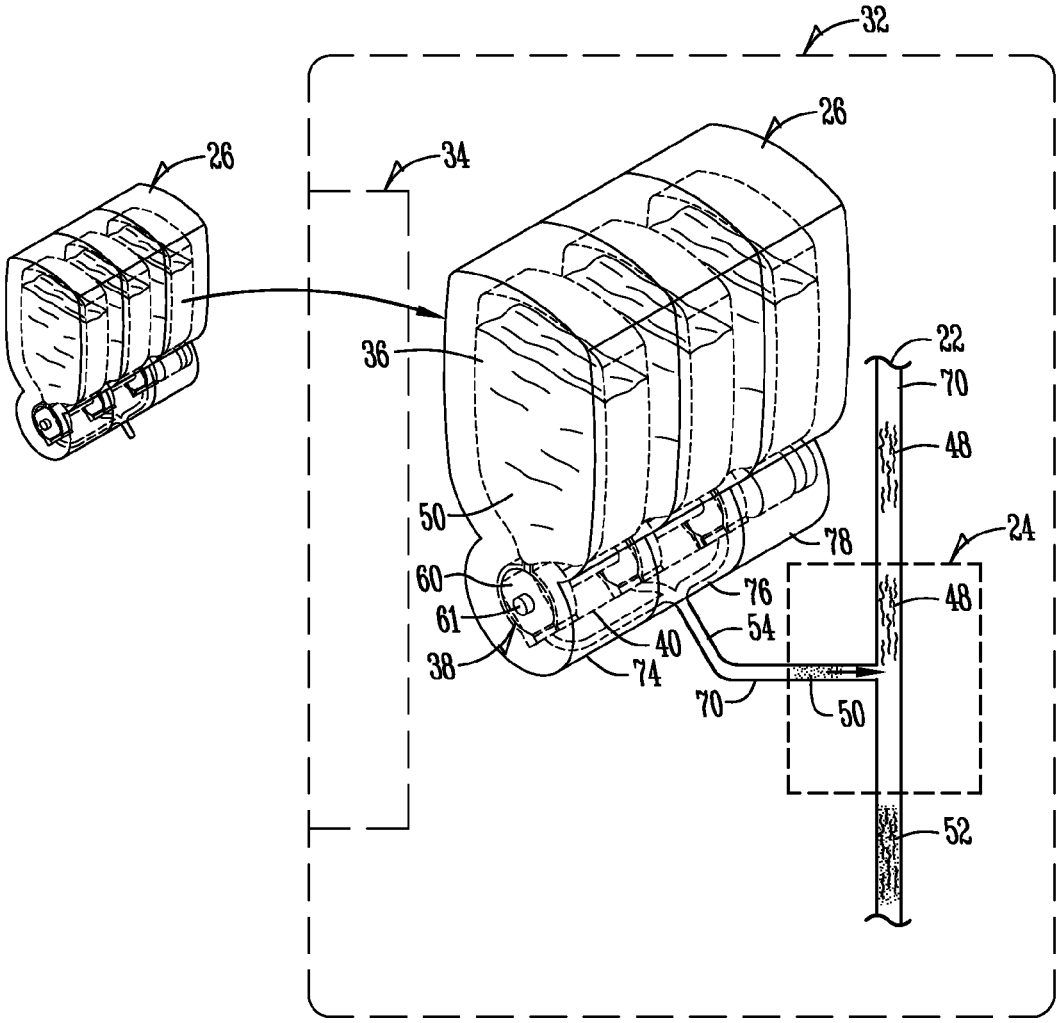
FIG. 5B is a diagram illustration of the apparatus shown in FIG. 5A being used in combination with a beverage preparation system.

FIGS. 5A-5B illustrate another aspect of the present invention. The liquid additive system 26 illustrated in FIG. 5A, similar to previous aspects of the invention, includes a housing 72 within which is contained several liquid additive containers 36, each container connected in liquid communication with a pumping section associated with pump 38. The housing shown in FIG. 5A may be configured as a pod, pouch or cartridge or other housing design suitable for containing one or more liquid additive containers and a pump. Enclosed within the housing 72, as shown in FIG. 5A, are three liquid additives containers 36. The outlet of each container is connected in fluid communication with a pumping section of the pump 38. For example, a first liquid additive container is connected in liquid communication with a first pumping section 74, a second liquid additive container is connected in liquid communication with a second pumping section 76, and a third liquid additive container is connected in liquid communication with a third pumping section 78. The first, second and third pumping sections are contained within pump housing 40 of pump 38. Each pumping section is sealed off from the other pumping sections and includes a rotor 60 mounted on and rotated by a single shaft 61 driven by a motor 80 powered by a power source 82. Each pumping section includes an outlet connected in liquid communication with a common outlet 54 for the housing 72. In operation, power source 82 provides electricity to motor 80 for rotating shaft 61 which in turn imparts rotation to rotor 60. Rotation of the shaft 61 imparts rotation to the rotor 60 in each of the first, second and third pumping sections 74, 76 and 78, respectively. Liquid additive 50 within the liquid additive container 36 is pumped through the inlet and out the outlet 54 of the liquid additive system 26. Micro actuated valves such as those previously discussed and illustrated may be connected between the outlet of each liquid additive container and the inlet of the respective pumping section associated with pump housing 40 to control the flow of liquid additive from each of the liquid additive containers through the pump housing 40 and out the outlet 54. Alternatively, to dispense a liquid additive from one liquid additive container and not another, or dispense liquid additives independent of the other, the shaft 61 may be configured with ribbings, gears, spines, detents or other geometries that interface with specific opposing geometries in each of the individual pumping sections so that if one pumping section is desired to pump and another is desired to not pump, the shaft may be translated by a micro actuator back and forth so as to engage certain geometries associated with the first pumping section and rotor in the first pumping section to cause the rotor to rotate and pump liquid additive from liquid additive container out the outlet 54. Similarly, if a different liquid additive is desired, the shaft by way of a micro actuator, may be shifted to a second or third position whereby a different set of geometries positioned on the shaft 61 are brought into contact with corresponding geometries associated with the rotor in the desired pumping section so as to rotate the rotors and pump liquid additive out the outlet of housing 72. In this manner, by shifting the shaft 61 laterally relative to each of the rotors associated with the first pumping section 74, second pumping section 76 and third pumping section 78 the system is able to control which liquid additive container the liquid additive system dispenses liquid additive from without having to dispense from each of the liquid additive containers simultaneously. As with previous aspects of the invention, the liquid additive containers 36 could be filled with an additive for preparing a beverage or for maintaining the liquid additive system 26 or beverage preparation system 24 illustrated in FIG. 5B.

FIG. 5B illustrates the liquid additive system 26 shown in FIG. 5A used in combination with the liquid dispensing platform such as a dispenser of the refrigerator shown in FIG. 1. The liquid dispensing platform, such as a refrigerator appliance or other liquid dispensing appliance, includes a beverage dispensing system 32, such as the dispenser 20 shown in FIG. 1. The beverage dispensing system 32 includes a loading and unloading interface 34 through which liquid additive system 26 is inserted and retrieved from the beverage dispensing system 32. Similar to the liquid additive system 26 illustrated in FIG. 4B, when the liquid additive system 26 shown in FIG. 5B is docked within the beverage dispensing system 32, the outlet 54 associated with housing 72 is connected in liquid communication with conduit 70 connected to the beverage preparation system 24 associated with the liquid dispensing platform. Similarly, an electronic interface associated with housing 72 is brought into electronic communication with corresponding hardware associated with the beverage dispensing system 32 for receiving instructions for operating the motor driving shaft 61 and each of the rotors housed within the first pumping section 74, the second pumping section 76, and the third pumping section 78 of the pump housing 40. A user interface associated with the liquid dispensing platform, such as a dispenser associated with the refrigerator shown in FIG. 1, may be used for inputting instructions for operating the liquid additive system 26. In operation, a user/operator selects the type of beverage to be dispensed. The beverage type may be selected from the user interface associated with the liquid dispensing platform. Electronic communication with the liquid additive system 26 may provide a listing of the type of liquid additives contained in the liquid additive system 26. As illustrated in FIG. 5B, the liquid additive system includes three liquid additive containers 36. Each container could include a different additive for preparing a single beverage or multiple beverages. In the case where the beverage type requires that liquid additive 50 is dispensed from each of the liquid additive containers 36, shaft 61 rotates to impart rotation to each of the rotors within the first, second and third pumping sections 74, 76 and 78 respectively to pump the liquid additive from each of the containers through the pump housing 40 out the outlet 54 into the beverage preparation system 24. In the case where the beverage being prepared requires that less than all three of the liquid additive containers 36 be dispensed from at a single time, a micro actuator through electronic communication with a controller or control board associated with the liquid dispensing platform may be actuated to align certain geometries associated with shaft 61 with corresponding geometries associated with one or more of the rotors in the first, second and third pumping sections 74, 76 and 78 so that the desired rotor associated with the desired liquid additive container is rotated without rotating the others to pump liquid additive from the container through the pump housing 40 and into the beverage preparation system 24. Alternatively, the liquid additive system 26 may be configured with micro actuated valves, such as those previously discussed and described, whereby electronic actuation of a valve allows one liquid additive container 36 to be in communication with its respective pumping section within pump housing 40 of pump 38 so as to pump liquid additive from the container through the pump housing and into the beverage preparation system 24. Depending upon the desired beverage, instructions from an operating system may be provided to the liquid additive system 26 to control operation of the micro actuated valves associated with each liquid additive container so as to control when each additive container dispenses a liquid additive for preparing the desired beverage. As with other aspects of the invention, one or more of the liquid additive containers 36 may include a component such as a de-scaling component or anti-microbial component for treating, maintaining and preventing contamination of the beverage dispensing system 32 associated with the liquid dispensing platform in which the beverage preparation system 24 and liquid additive system 26 are used. The liquid additive 50 dispensed from the liquid additive system 26 is communicated through conduit 70 into beverage preparation system 24. In the beverage preparation system 24 the liquid additive is combined with liquid 48 from source 22 to prepare a finished beverage 52.

Figure 6A:
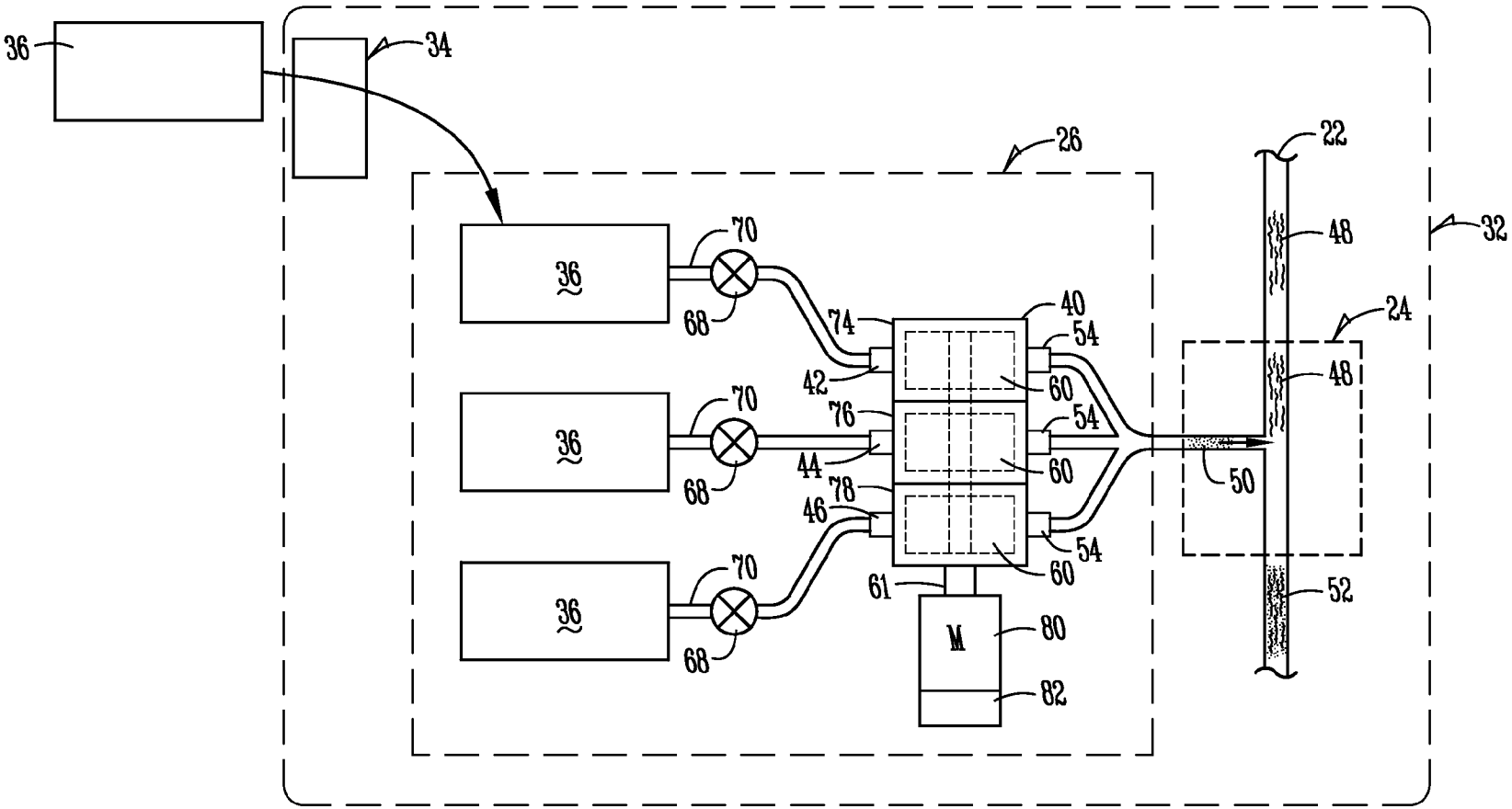
FIG. 6A is an illustration depicting a multiple inlet and pump housing additive dispensing system using combination with a beverage preparation system using micro actuated valves for controlling flow of the liquid additive from liquid additive containers from the pump housing.
Figure 6B:
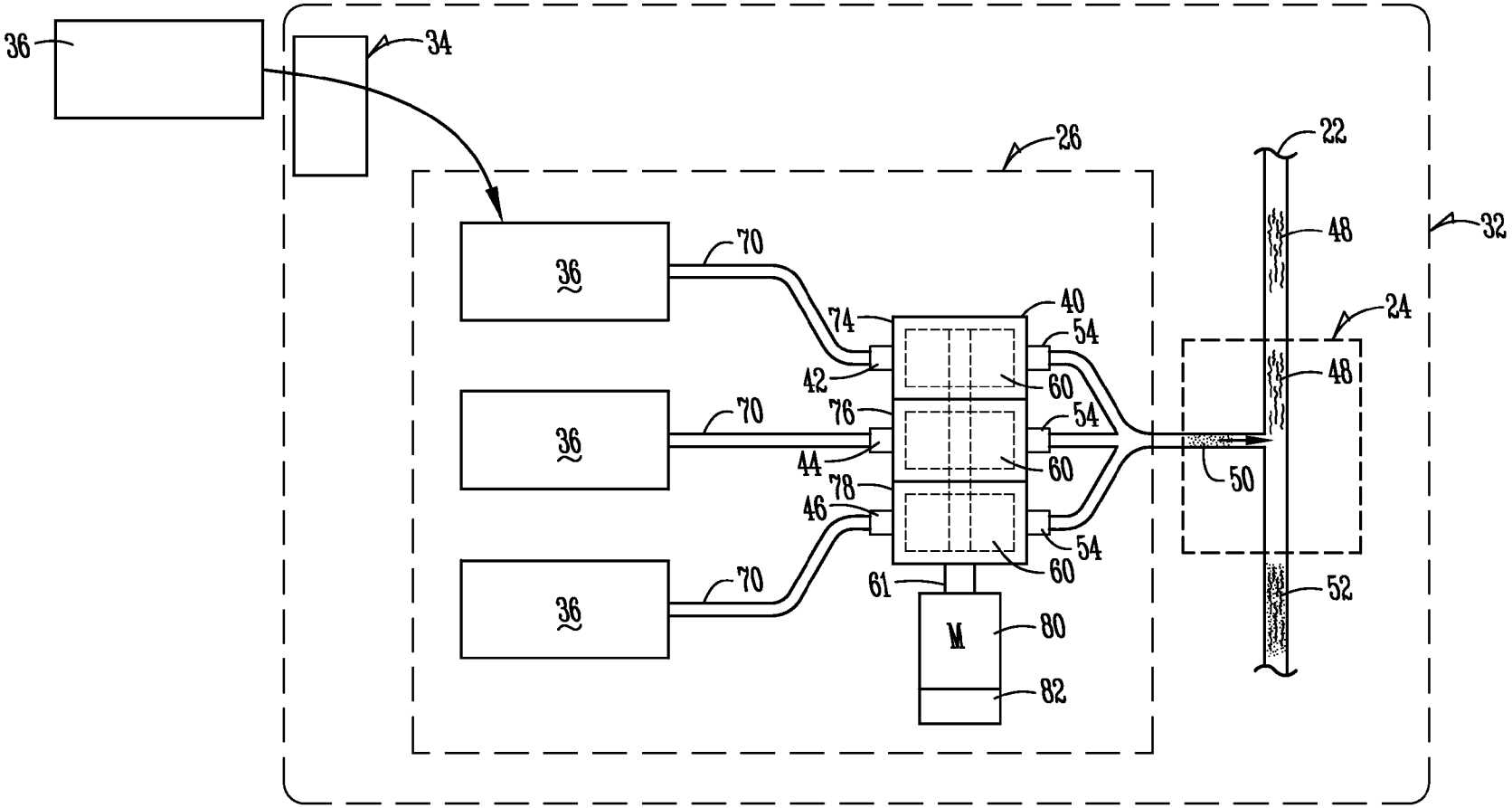
FIG. 6B is an illustration depicting a valueless version of the multiple inlet and pump housing additive dispensing system shown in FIG. 6A.

FIGS. 6A-6B illustrate other aspects of the present invention. FIG. 6A illustrates the pump housing shown in FIGS. 5A-5B used in combination with a liquid dispensing platform such as a dispenser of a refrigerator illustrated in FIG. 1. A liquid dispensing platform could be configured to include a beverage dispensing system 32 as illustrated in FIG. 6A. The beverage dispensing system 32 includes an additive loading and unloading interface as previously discussed and described supra. Liquid additive containers 36 are inserted into the beverage dispensing system 32 through the interface 34. Liquid additive containers 36 may also be removed from the beverage dispensing system 32 through the interface. The beverage dispensing system 32 includes a liquid additive system 26 into which liquid additive containers 36 are inserted and removed. The liquid additive containers 36 may contain any flavoring, concentrate or other component as previously discussed and described supra. Each liquid additive container 36 is docked into the liquid additive system 26. Placement of the liquid additive container 36 into the liquid additive system 26 connects conduit 70 with the container. Each liquid additive container 36 is connected in liquid communication with an inlet of the pump housing 40 of pump 38. One liquid additive container 36 is connected to the primary inlet 42 of pump housing 40 via conduit 70. Another liquid additive container 36 is connected to the secondary inlet 44 of pump housing 40 via a conduit 70. Likewise, a third liquid additive container 36 is connected to the tertiary inlet 46 of pump housing 40 via a conduit 70. Connected between the liquid additive container 36 and each inlet of the pump housing 40 is a micro actuated valve 68. The micro actuated valve 68 controls the flow of liquid additive from the liquid additive container 36 to an inlet of the pump housing 40. The primary inlet 42 of pump housing is in direct communication with first pumping section 74, the secondary inlet 44 of the pump housing 40 is in direct communication with second pumping section 46, and the tertiary inlet 46 of the pump housing 40 is in direct communication with the third pumping section 78. The first pumping section 74, second pumping section 76 and third pumping section 78 are separate housings contained within the overall pump housing 40. The first pumping section 74 includes a rotor 60, the second pumping section 76 includes another rotor 60 and the third pumping section 78 includes another rotor 60. The three rotors being separate from each other but connected by the same shaft 61 driven by motor 80 powered by source 82. Electricity from the source 82 drives the motor 80 which imparts rotation to shaft 61 for rotating each of the rotors within the individual pumping sections of the pump 38. Each pumping section 74, 76 and 78 have an outlet 54 connected in common by a conduit 70 which is in turn connected to the beverage preparation system 24.

In operation, a user/operator selects the desired liquid additive or additives and inserts the liquid additive container(s) 36 into the liquid additive system 26 through the interface 34. The liquid additive system 26 is configured to recognize the type of liquid additive container 36 docked within the system. A user/operator may select through an operator's interface (on a liquid dispensing platform) the desired beverage. For example, a user/operator may use the user interface associated with dispenser 20 of refrigerator 10 shown in FIG. 1 to select the desired beverage. Instructions are received at the pump 38 and micro actuated valves 68 from a controller or control board associated with the interface of the liquid dispensing platform. A valve (not shown) associated with the liquid source 22 opens to allow liquid 48 to travel through conduit 90 of the beverage preparation system 24. The micro actuated valve 68 associated with the desired liquid additive is opened to allow the flow of liquid additive through conduit 70 to an input of the pump housing 40. The motor 80 is actuated and imparts rotation to shaft 61 which turns rotor 60 for pumping liquid additive from the liquid additive container 36 through the conduit into the beverage preparation system 24. The liquid additive 50 is combined with liquid 48 from the liquid source 22 to provide a finished or completed beverage 52. In the case where the finished beverage requires more than one liquid additive, more than one micro actuated valve 68 may open up simultaneously or sequentially to allow liquid additives to pump from liquid additive containers 36 through pump housing 40 into the beverage preparation system 24. Any number of the micro actuated valves 68 may be opened at one time to accommodate preparations of the finished beverage 52. As with other aspects of the invention, an additive container could include any number of additives or components for cleaning, maintaining and preserving the hygienical integrity of the beverage preparation system 24 and liquid additive system 26. For example, one liquid additive system 26 could include an anti-microbial component that is cycled through the liquid additive system 26 and beverage preparation system 24 after the preparation of each finished beverage 52 for insuring that the beverage dispensing system 32 is hygienically safe for preparing and dispensing the next beverage. Anti-microbial components or other agents used for cleaning and maintaining the system are those suitable for use in combination with food grade systems.

FIG. 6B illustrates another aspect of the beverage dispensing system 32 illustrated in FIG. 6A. The beverage dispensing system 32 illustrated in FIG. 6B operates similar to the system illustrated in FIG. 6A. However, the system illustrated in FIG. 6B is configured without micro actuated valves 68 being placed between the outlet of each liquid additive container 36 and the primary inlet 42, secondary inlet 44 and tertiary inlet 46 of pump housing 40. FIG. 6B illustrates a valveless version of the liquid additive system shown in FIG. 6B. In this aspect of the invention, pump 38 is configured to control which rotor in which pumping section of the pump housing 40 rotates thereby controlling which liquid additive is dispensed to the beverage preparation system 24. As with previous aspects of the invention, the rotors 60 contained within each pumping section 74, 76 and 78 are driven by shaft 61. Rotation is imparted to shaft 61 by motor 80 receiving electricity from power source 82. In one aspect of the invention, each rotor includes an electromagnetic responsive sleeve (not shown) through which shaft 61 extends. Mounted on the shaft 61 relative to the electromagnetic sleeve within each rotor are electromagnetic members which are electrically connected to power source 82. For example, the rotor 60 in the first pumping section 74 includes at its core an electromagnetic sleeve surrounding the shaft that passes through the rotor 60. On the outer peripheral surface of the shaft 61 are positioned electromagnetic members. These electromagnetic members (not shown) are connected to the shaft and rotate within the electromagnetic sleeve attached to the rotor. The rotor within the second pumping section 76 and the rotor within the third pumping section 78 are configured likewise. Depending upon the liquid additive that is selected by the user the controller or control board electrically charges the magnetic members fixed to the outer peripheral surface of the shaft 61 for the rotor that needs to turn to pump liquid additive to the beverage preparation system 24. For example, if the rotor 60 within the first pumping section 74 is to be rotated to pump liquid additive into the beverage preparation system 24 the electromagnetic members attached to the shaft within the electromagnetic sleeve of the rotor in the first pumping section 74 are electromagnetically actuated or charged so as to electromagnetically grip the sleeve within the rotor and impart rotation from the shaft to the rotor for pumping liquid additive from the liquid additive container 36 into the beverage preparation system 24. The electromagnetic members associated with each rotor may be electrically charged individually, consecutively or in any order in which dispensing should occur to prepare the finished or completed beverage 52. For example, the rotor 60 in the first pumping section 74 and in the third pumping 78 may be rotated at the same time by electromagnetically charging the electromagnetic members attached to the shaft 61 within the electromagnetic sleeve of the rotor in the first pumping section 74 and the rotor in the third pumping section 78. In the case where the finished beverage requires that each of the rotors turn to pump liquid additive from the containers to the beverage preparation system 24 the electromagnetic members within each electromagnetic sleeve for the rotor 60 in the first pumping section 74, the second pumping section 76 and the third pumping section 78 are electromagnetically charged to grip the sleeve and thereby impart rotation from the shaft to the rotors for turning each of the rotors and pumping liquid additive from each of the containers to the beverage preparation system 24 for preparing the finished or complete beverage 52. Alternative embodiments for imparting rotation from the shaft 61 to each of the rotors in the separate pumping sections are also contemplated as described and suggested supra.

The preferred embodiments of the present invention have been set forth in the drawings and the specification although specific terms are employed, these are used in the generically descriptive sense only and are not used for the purpose of limitation. Changes in the form proportion of parts as well as substitution of equivalents are contemplated as the circumstances may suggest or render expedient without departing from the spirit or scope of the invention as further defined in the following claims.

What is claimed is:

1. A liquid consumable dispensing apparatus for beverage preparation, comprising:

a pump housing;

rotor housings enclosed by the pump housing;

rotors operably housed in the rotor housings;

closed chambers boundaried by an outer surface of the rotors and an inner surface of the rotor housings between apices on the rotors;

liquid consumable inlets and outlets in the rotor housings;

a shaft operably connected between rotors and rotor housings, the shaft adapted for connection to a motor; and one operating mode wherein the shaft turns a first one of the rotors and another operating mode wherein the shaft turns a second one of the rotors.

2. The liquid consumable dispensing apparatus of claim 1 further comprising: separate liquid consumable containers operably connected in fluid communication with liquid consumable inlets in the rotor housings.

3. The liquid consumable dispensing apparatus of claim 1 further comprising: at least one operating mode wherein the first one and second one of the rotors turn together.

4. The liquid consumable dispensing apparatus of claim 1 in combination with a beverage dispensing system of a refrigerated appliance.

5. The liquid consumable dispensing apparatus of claim 1 wherein the second one of the rotors is stationary in the one operating mode.

6. The liquid consumable dispensing apparatus of claim 1 wherein elastomeric members comprise a portion of the inner surface of the rotor housings.

7. The liquid consumable dispensing apparatus of claim 1 wherein the liquid consumable inlets are separated by apices on the rotor.

8. A liquid consumable dispensing apparatus for beverage preparation, comprising:

a pump housing;

at least two rotor housings enclosed by the pump housing;

at least two rotors operably each housed within one of the at least two rotor housings;

closed chambers boundaried by an outer surface of one of the at least two rotors and an inner surface of one of the at least two rotor housings between apices on each of the at least two rotors;

a liquid inlet and a liquid outlet disposed on each of the at least two rotor housings;

a shaft operably connected between the at least two rotors and rotor housings, the shaft operably connected to a motor; and a first operating mode wherein the shaft turns a first one of the at least two rotors and a second operating mode wherein the shaft turns a second one of the at least two rotors.

9. The liquid consumable dispensing apparatus of claim 8 further comprising:

a liquid consumable container in liquid communication with the liquid inlet on one of the at least two rotor housings.

10. The liquid consumable dispensing apparatus of claim 8 further comprising:

at least one operating mode wherein two of the at least two rotors turn together.

11. The liquid consumable dispensing apparatus of claim 8 in combination with a beverage dispensing system of a refrigerated appliance.

12. The liquid consumable dispensing apparatus of claim 8 wherein a first one of the at least two rotors is stationary in the one operating mode.

13. The liquid consumable dispensing apparatus of claim 8 wherein elastomeric members comprise a portion of the inner surface of the at least two rotor housings.

14. The liquid consumable dispensing apparatus of claim 8, further comprising:

a second liquid disposed on one of the at least two rotor housings.

15. A liquid consumable dispensing apparatus for beverage preparation, comprising:

a housing;

a first rotor housing enclosed by the housing and having an inner surface, and enclosing a first rotor with an outer surface;

a second rotor housing enclosed by the pump housing, and enclosing a second rotor with an outer surface;

a first inlet chamber defined between the outer surface and the inner surface;

a first liquid inlet on the first rotor housing;

a first liquid outlet on the first rotor housing;

a motor;

a shaft operably connected to the first rotor, the second rotor, and the motor; and a first operating mode wherein the shaft turns the first rotor and the second rotor remains stationary.

16. The liquid consumable dispensing apparatus of claim 15, further comprising a second operating mode wherein the shaft turns the second rotor and the first rotor remains stationary.

17. The liquid consumable dispensing apparatus of claim 15 further comprising:

at least one operating mode wherein the first one and second one of the rotors turn together.

18. The liquid consumable dispensing apparatus of claim 15 in combination with a beverage dispensing system of a refrigerated appliance.

19. The liquid consumable dispensing apparatus of claim 15 wherein elastomeric members comprise a portion of the inner surface of the first rotor housing.

20. The liquid consumable dispensing apparatus of claim 8, further comprising:

a second liquid inlet disposed on the first rotor housing.

* * * * *